US006446803B1

(12) United States Patent
McKinney

(10) Patent No.: US 6,446,803 B1
(45) Date of Patent: Sep. 10, 2002

(54) COMBINATION BOOKMARK AND WRITING INSTRUMENT CASE

(76) Inventor: Christina McKinney, P.O. Box 93, 236, Lubbock, TX (US) 79493

( * ) Notice: Subject to any disclaimer, the term of this patent is extended or adjusted under 35 U.S.C. 154(b) by 0 days.

(21) Appl. No.: 09/741,181

(22) Filed: Dec. 21, 2000

Related U.S. Application Data

(60) Provisional application No. 60/213,625, filed on Jun. 23, 2000.

(51) Int. Cl.[7] ..... B65D 85/28

(52) U.S. Cl. ..... 206/371; 206/214; 206/224; 116/239; 224/901.4

(58) Field of Search ..... 206/37, 38, 214, 206/224, 371, 484, 484.2, 424; 116/234, 237–239; 224/219, 221, 222, 901.4; 281/42, 45

(56) References Cited

U.S. PATENT DOCUMENTS

| | | | | | |
|---|---|---|---|---|---|
| 2,066,992 | A | | 1/1937 | Matson | |
| 2,300,216 | A | | 10/1942 | Grodsky et al. | |
| 2,664,847 | A | * | 1/1954 | Orman | 116/239 |
| 3,068,840 | A | | 12/1962 | Pullins | |
| 3,898,951 | A | * | 8/1975 | Clare | 116/239 |
| 4,041,892 | A | * | 8/1977 | Nichols | 116/239 |
| 4,162,800 | A | | 7/1979 | Gonot, Jr. et al. | |
| 4,505,219 | A | | 3/1985 | Mangano | |
| D294,660 | S | | 3/1988 | Strongwater | |
| 4,961,596 | A | * | 10/1990 | Moor | 206/214 |
| 5,020,711 | A | * | 6/1991 | Kelley | 224/222 |
| 5,054,816 | A | | 10/1991 | Rosengarten | |
| 5,170,917 | A | * | 12/1992 | Tourigny | 224/901.4 |
| 5,405,010 | A | | 4/1995 | Goldberger | |
| 5,501,171 | A | | 3/1996 | Leake | |

* cited by examiner

*Primary Examiner*—Luan K. Bui
(74) *Attorney, Agent, or Firm*—Joseph Scafetta, Jr.

(57) ABSTRACT

A combination bookmark and writing instrument case is attached to either a front cover, a back cover or a spine of a book. A case portion has a front panel and a back panel which together form a pocket therebetween for releasably holding at least one writing instrument therein. A bookmark portion has two straps spaced apart from each other. These straps are stretchable to encircle either the front cover, the back cover or the spine so as to mark simultaneously two places in the book.

14 Claims, 5 Drawing Sheets

COMBINATION BOOKMARK AND WRITING INSTRUMENT CASE

CROSS-REFERENCE TO RELATED APPLICATIONS

This application is derived from U.S. Provisional Patent Application Serial No. 60/213,625 filed on Jun. 23, 2000, and is related to U.S. Design patent application Ser. No. 29/134,625 filed on Dec. 21, 2000.

BACKGROUND OF THE INVENTION

1. Field of the Invention

The present invention relates to a combination bookmark and writing instrument case which attaches to a front cover, a back cover or a spine of a book so as to mark either one or two places for a reader.

2. Description of the Prior Art

U.S. Pat. No. 5,501,171 of Leake shows a combination bookmark and case for a single writing instrument. This prior art device is made of flexible fabric which merely rests between two facing pages of the book and does not wrap completely therearound so as to encircle the book. Also, Leake does not secure the writing instrument case to the book but rather allows the case to move freely. Thus, this freedom of movement permits the case possibly to dislodge the bookmark from the book.

U.S. Pat. No. 5,405,010 of Goldberger shows a combination bookmark and eyeglass case which attaches only to the front cover of the book so as to mark a single page for the reader . Because the eyeglass case is so bulky, it does not wrap around the spine of the book. Thus, other books cannot be stacked on top of the marked book.

U.S. Pat. No. 5,054,816 of Rosengarten discloses a double looped bookmark which lacks a writing instrument case. Although one loop indexes a page in the book for the reader, the second loop secures the book in a closed position by wrapping completely therearound. Thus, this second loop does not function as a writing instrument holder.

U.S. Design Pat. No. 294,660 of Strongwater shows a holder for a single pen or pencil. This holder wraps around an automobile visor or a similar article. However, there is no suggestion or disclosure that the similar article may be a book.

U.S. Pat. No. 4,505,219 of Mangano illustrates an adjustable bookmark for attachment around the rear cover of either a paperback or a hard cover book. However, the thickness and the width of the bookmark make it clear that the device is not intended to be attached to the spine of the book.

U.S. Pat. No. 4,162,800 of Gonot, Jr., et al., discloses a combination bookmark and writing instrument case which is an elastic band attachable to a variety of books with different thicknesses. This elastic band may have a single seam or it may be seamless. Thus, this band is incapable of wrapping around the spine of the book.

U.S. Pat. No. 3,068,840 of Pullins illustrates a pencil holder which has snaps that secure the holder around the spine of the book. Nevertheless, this device is neither disclosed nor suggested to function also as a bookmark.

U.S. Pat. No. 2,300,216 of Grodsky et al. shows a combination bookmark and pencil holder which merely rests between two facing pages of the book and does not encircle either the front cover, the back cover or the spine.

U.S. Pat. No. 2,066,992 of Matson illustrates a pencil holder which is attached to the spine of the book. However, the device is not a bookmark.

SUMMARY OF THE INVENTION

It is a primary object of the present invention to provide a bookmark in combination with a case for writing instruments. The combined bookmark and case may be attached to either the front cover, the back cover, or the spine of the book.

It is a secondary object of the present invention to provide a bookmark for indexing either one or two-nonfacing pages in a book.

It is a tertiary object of the present invention to provide a writing instrument case which may be attached to the spine of one of a plurality of stacked books while marking either one or two places in the attached book.

These objects are accomplished in accordance with the present invention by providing a combination bookmark and writing instrument case which has a front panel secured to a back panel along three edges. The back panel extends beyond the front panel at an open end to form a pocket for receiving at least one writing instrument therein. Also, the bookmark portion has two elastic straps forming loops and being attached to the back panel of the writing instrument case. These two straps wrap around a selected number of pages from the front cover and the back cover of the book so as to mark two different pairs of facing pages in the book. Also, these straps may be either permanently secured by sewing or releasably attached by VELCRO® to the back panel of the writing instrument case.

Other objects and features o f the present invention will be come apparent from the following detailed description when considered in connection with the accompanying drawings which illustrate preferred embodiments of the present invention.

DETAILED DESCRIPTION OF THE INVENTION

Figure 1:
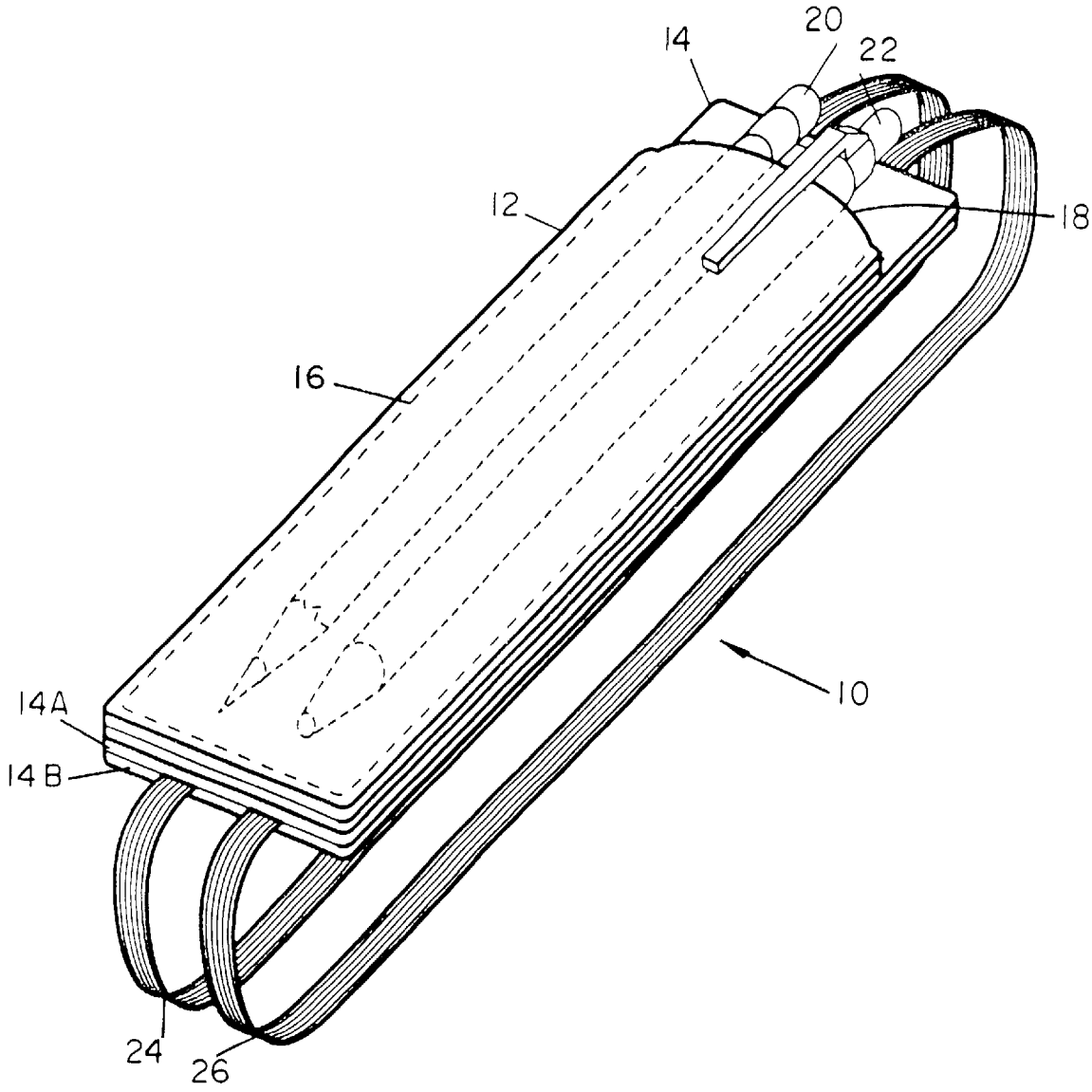
FIG. 1 shows a front perspective view of a first embodiment of the invention holding two writing instruments.

In FIG. 1, the combination 10 has a two-ply front panel 12 secured to a two-ply back panel 14 either by adhesives or by stitches 16 sewn at a periphery around three side edges of the front panel 12 to form a pocket 18 with the back panel 14. This pocket 18 releasably holds writing instruments, such as a pencil 20 and a pen 22. The panels 12 and 14 are made of textile fabric or similar durable material. Left strap 24 and right strap 26 are secured at one end between upper ply 14A and lower ply 14B of the back panel 14. The straps 24 and 26 are spaced apart from each other by a gap of about two strap widths. These straps 24 and 26 are made of stretchable material, such as elastic bands or lycra®, which make the straps 24 and 26 capable of stretching to wrap around many different sizes of books, both hardback and paperback. The width of the front panel 12 and the back panel 14 is preferably about 1.75 inches while the width of the straps 24 and 26 is each about 0.25 inch for a total width of 0.50 inch. A ratio of 1:7 for strap width to panel width has been found to be optimal for carrying out the bookmark function.

Figure 2:
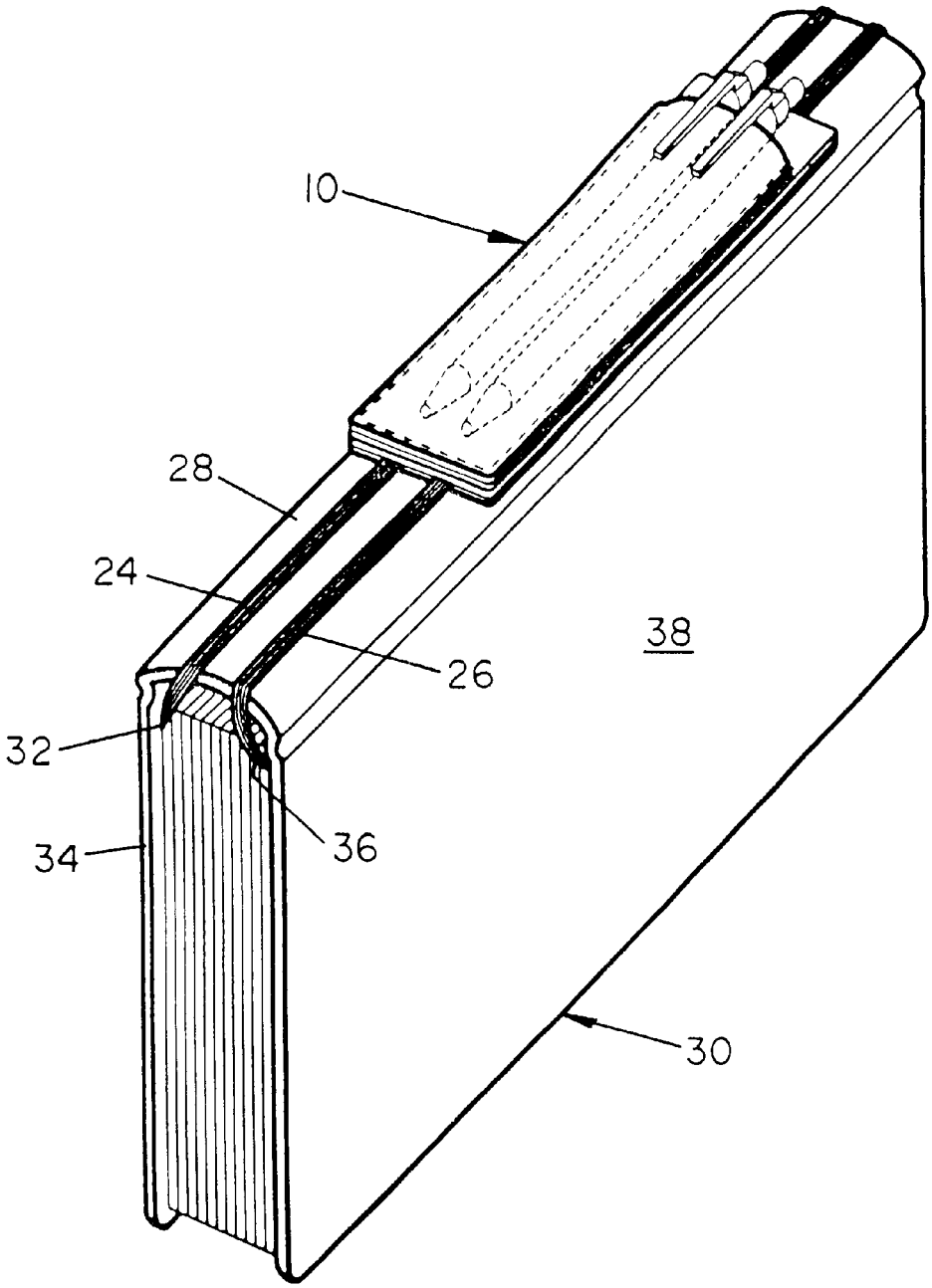
FIG. 2 shows a front perspective view of the invention attached to the spine of the book and marking two pages therein.

As shown in FIG. 2, the combination 10 is mounted on a spine 28 of a book 30. The left strap 24 is stretched to mark a first place 32 between two facing pages near to a back cover 34 while the right strap 26 is stretched to mark simultaneously a second place 36 between two different facing pages near to a front cover 38 of the book 30. In this arrangement, the book 30 is capable of being stacked with other books (not shown) while the combination 10 is still mounted on the spine 28. Thus, this arrangement is particularly convenient for use by students with several textbooks.

Figure 3:
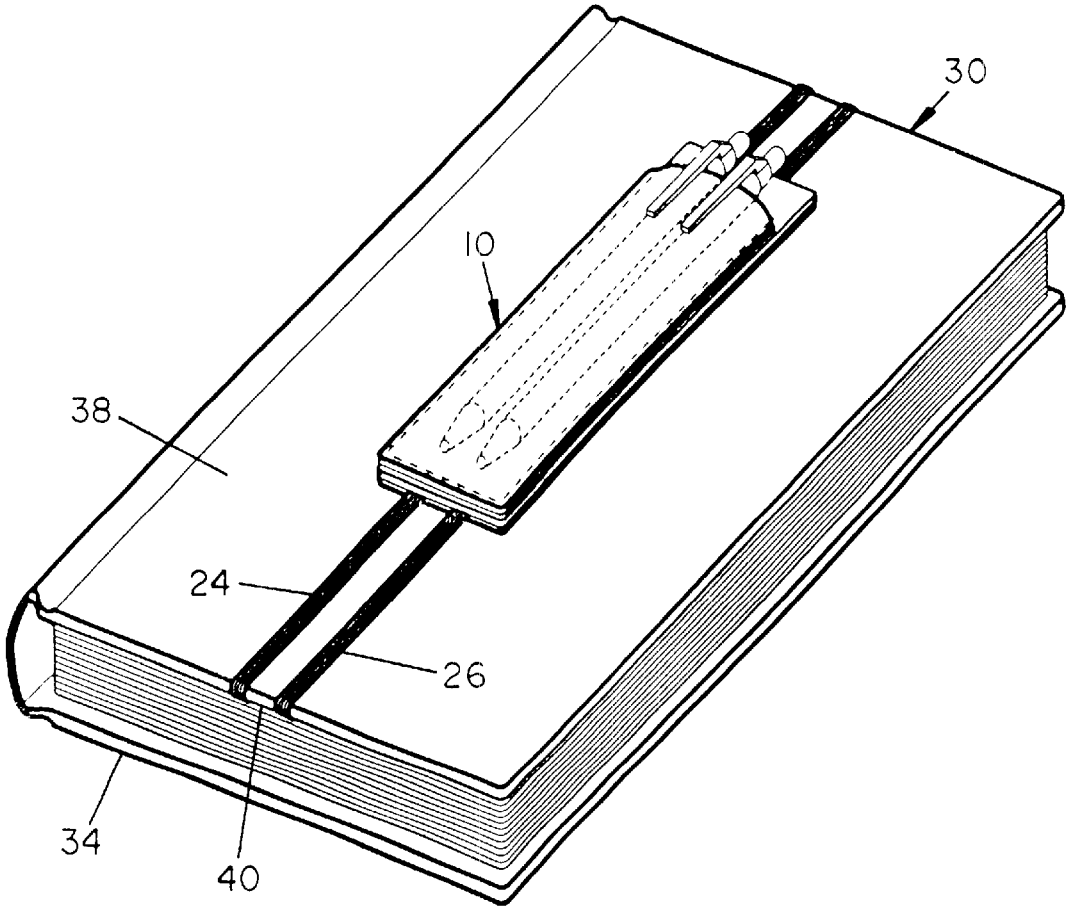
FIG. 3 shows a front perspective view of the invention attached to the front cover of the book and marking one page therein.

As shown in FIG. 3, the combination 10 may be attached to the front cover 38 of the book 30 by stretching the straps 24 and 26 thereover to mark a third place 40 between two facing pages near to the front cover 38. Alternatively, the left strap 24 alone may mark the third place 40 while the right strap 26 marks a fourth place (not shown). Of course, the combination 10 may be attached in a similar "backpack" style to the back cover 34 so as to have the left strap 24 mark a fifth place (not shown) while the right strap 26 marks a sixth place (not shown) near to the back cover 34.

Figure 4:
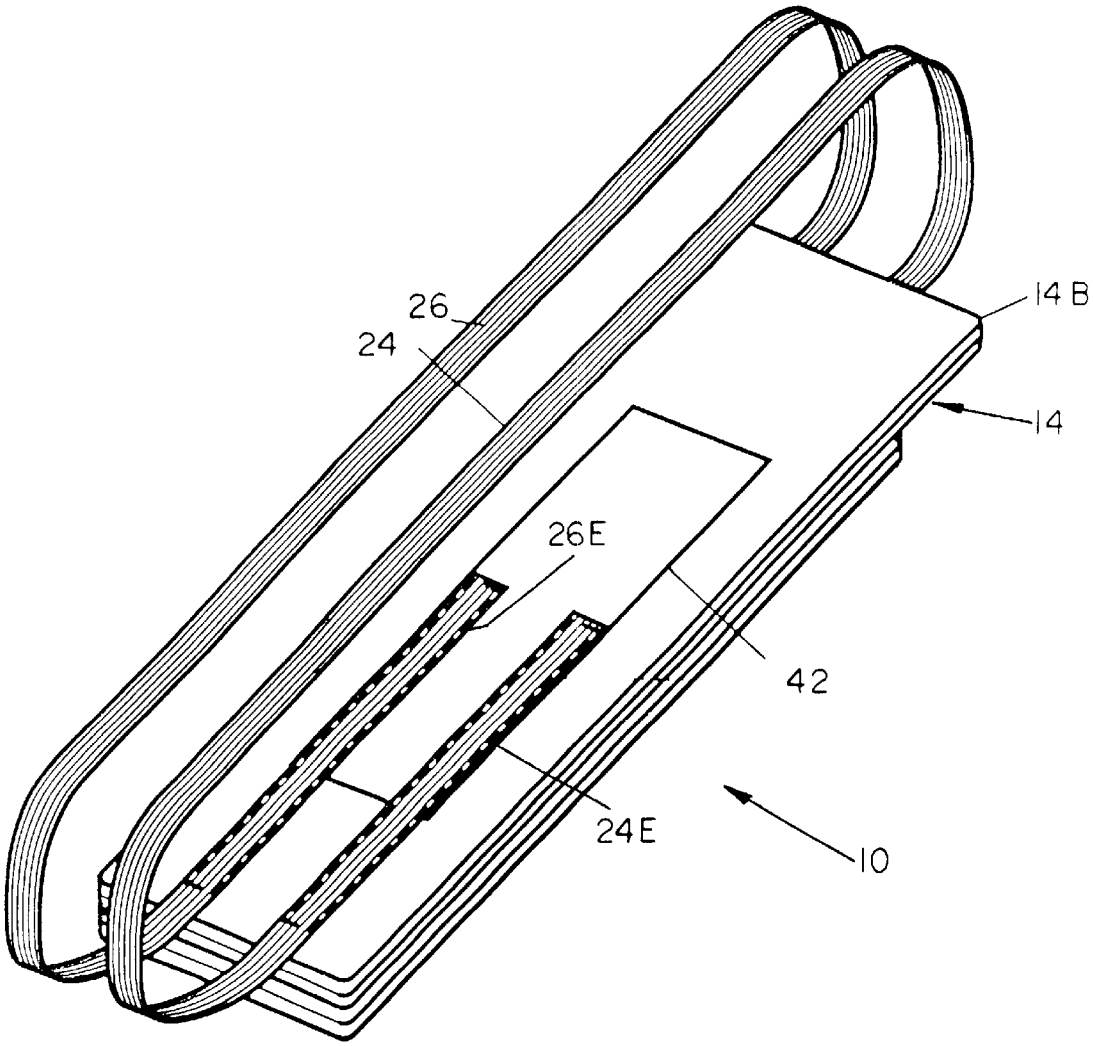
FIG. 4 shows a rear perspective view of the invention.

FIG. 4 shows a rear perspective view of the combination 10 with a patch 42 of hook-and-loop fasteners, such as VELCRO®, secured to an underside of the lower ply 14B of the back panel 14. Both straps 24 and 26 have matching hook-and-loop fasteners on their other ends 24E and 26E, respectively, for fastening to the patch 42. Because the ends 24E and 26E are aligned in tandem with each other on the patch 42, it is possible to adjust the overall length of the straps 24 and 26 so that they may mark pages in books of different thicknesses. Snaps or similar devices spaced apart could be used to carry out this length-adjusting function instead of hook-and-loop fasteners.

Alternatively, the ends 24E and 26E of the straps 24 and 26, respectively, could be sewn to an underside of the lower ply 14B of the back panel 14 so that the straps 24 and 26 are permanently secured to the back panel 14 instead of being adjustable in their lengths.

Figure 5:
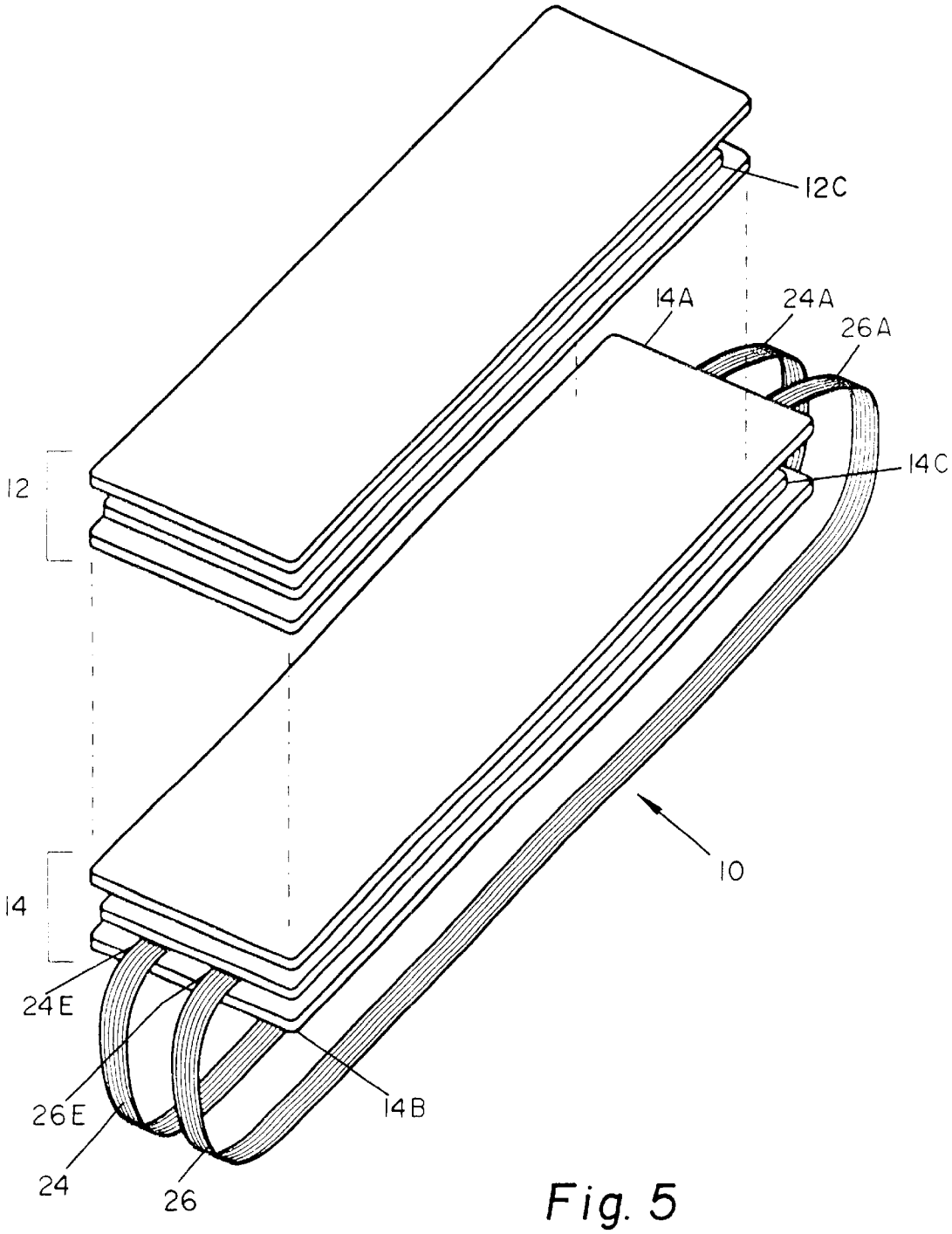
FIG. 5 shows an exploded front perspective view of a second embodiment of the invention with intermediate reinforcing panels.

In FIG. 5, a second embodiment is illustrated in which the front panel 12 and the back panel 14 are both arranged to have intermediate reinforcing panels 12C and 14C, respectively, to stiffen the case portion of the combination 10 and to hold the writing instruments more securely in the pocket 18 formed between the front panel 12 and the back panel 14. The ends 24E and 26E of the straps 24 and 26, respectively, are sewn to a top side of the lower ply 14B of the back panel 14 while opposite ends 24A and 26A of the straps 24 and 26, respectively, are sewn to an underside of the upper ply 14A of the back panel 14. The intermediate reinforcing panels 12C and 14C may be made of either plastic or cardboard.

Hence, it is possible to adjust the overall encircling length of the bookmark portion of the combination 10 to accommodate books 30 of various thicknesses, dimensions and lengths, depending upon the number of pages necessary to encompass. In other words, when the bookmark portion of the combination 10 is placed around the outside of the book 30 after the reader has stopped reading, the lengths of the straps 24 and 26 are adjustable so that, whenever the straps 24 and 26 are wrapped around either the front cover 38, the back cover 34 or the spine 28 of the book 30, the case portion will always be snugly resting and held conveniently in place.

It will be understood that the various details of the invention may be changed without departing from the scope of the invention. Furthermore, the foregoing description is given for the purpose of illustration only and not for the purpose of limitation since the scope of the invention is defined by the following claims.

I claim:

1. A combination bookmark and writing instrument case for attachment to one of a front cover, a back cover and a spine of a book, said combination comprising:

a case portion having a front panel and a back panel together forming a pocket therebetween for releasably holding at least one writing instrument therein; and a bookmark portion having two straps spaced apart from each other, said straps being stretchable to encircle one of the front cover, the back cover and the spine so that one strap marks one place in the book and the other strap marks a different place in the book;

wherein said back panel has two plys and said straps are secured at one end between the two plys of the back panel.

2. A combination according to claim 1, wherein:

said front panel is secured to the back panel at a periphery around three side edges of the front panel.

3. A combination according to claim 1, wherein:

said straps are spaced apart from each other by a gap of two strap widths.

4. A combination according to claim 1, wherein:

a width of each strap has a ratio of 1:7 with respect to a width of each panel.

5. A combination according to claim 1, further comprising:

intermediate reinforcing panels arranged in the front panel and the back panel to stiffen the case portion.

6. A combination according to claim 1, further comprising:

a patch of hook-and-loop fasteners secured to an underside of the back panel.

7. A combination according to claim 6, wherein:

said straps have matching hook-and-loop fasteners on ends thereof for fastening to the patch so as to adjust an overall length of the straps.

8. A combination bookmark and writing instrument case for attachment to one of a front cover, a back cover and a spine of a book, said combination comprising:

a case portion having a front panel and a back panel together forming a pocket therebetween for releasably holding at least one writing instrument therein; and a bookmark portion having two straps spaced apart from each other, said straps being stretchable to encircle one of the front cover, the back cover and the spine so that one strap marks one place in the book and the other strap marks a different place in the book;

wherein said back panel has two plys and said straps are sewn at both ends between the two plys of the back panel.

9. A combination according to claim 8, wherein:

said front panel is secured to the back panel at a periphery around three side edges of the front panel.

10. A combination according to claim 8, wherein:

said straps are spaced apart from each other by a gap of two strap widths.

11. A combination according to claim 8, wherein:

a width of each strap has a ratio of 1:7 with respect to a width of each panel.

12. A combination according to claim 8, further comprising:

intermediate reinforcing panels arranged in the front panel and the back panel to stiffen the case portion.

13. A combination according to claim 8, further comprising:

a patch of hook-and-loop fasteners secured to an underside of the back panel.

14. A combination according to claim 13, wherein:

said straps have matching hook-and-loop fasteners on ends thereof for fastening to the patch so as to adjust an overall length of the straps.

* * * * *

UNITED STATES PATENT AND TRADEMARK OFFICE

CERTIFICATE OF CORRECTION

PATENT NO. : 6,446,803 B1
DATED : September 10, 2002
INVENTOR(S) : Christina McKinney It is certified that error appears in the above-identified patent and that said Letters Patent is hereby corrected as shown below:

Column 1,
Line 8, change “patent application” to -- Patent Application --;
Line 9, change “29/134,625” to -- 29/134,395 --.

Column 2,
Line 29, change “be” to -- be- --.

Signed and Sealed this

Thirty-first Day of December, 2002

JAMES E. ROGAN
*Director of the United States Patent and Trademark Office*